US007008293B2

(12) United States Patent
Kurogouchi

(10) Patent No.: US 7,008,293 B2
(45) Date of Patent: Mar. 7, 2006

(54) POSITIONING JIG, SPRAY POLISHING DEVICE USING POSITIONING JIG AND SPRAY POLISHING METHOD

(75) Inventor: Toshio Kurogouchi, Ina (JP)

(73) Assignee: Olympus Optical Co., Ltd., Tokyo (JP)

( * ) Notice: Subject to any disclaimer, the term of this patent is extended or adjusted under 35 U.S.C. 154(b) by 294 days.

(21) Appl. No.: 10/238,352

(22) Filed: Sep. 9, 2002

(65) Prior Publication Data

US 2003/0060132 A1 Mar. 27, 2003

(30) Foreign Application Priority Data

Sep. 11, 2001 (JP) ..... 2001-275528

(51) Int. Cl.
*B24C 1/00* (2006.01)

(52) U.S. Cl. ..... 451/2; 451/38; 451/442

(58) Field of Classification Search ..... 451/2, 451/3, 38–40, 42, 9–10, 442, 78, 82
See application file for complete search history.

(56) References Cited

U.S. PATENT DOCUMENTS

| | | | | |
|---|---|---|---|---|
| 1,588,768 | A * | 6/1926 | Moulton | 65/61 |
| 5,573,446 | A * | 11/1996 | Dey et al. | 451/39 |
| 5,971,835 | A * | 10/1999 | Kordonski et al. | 451/38 |
| 6,244,927 | B1 * | 6/2001 | Zeng | 451/2 |
| 6,769,956 | B1 * | 8/2004 | Konieczny | 451/2 |

* cited by examiner

*Primary Examiner*—Robert A. Rose
(74) *Attorney, Agent, or Firm*—Frishauf, Holtz, Goodman & Chick, P.C.

(57) ABSTRACT

A positioning jig which is applied to a spray polishing device which sprays a polishing liquid to a material to be polished and polishes the material to be polished, determines a relative position of a material to be polished and a polishing liquid spraying nozzle.

28 Claims, 4 Drawing Sheets

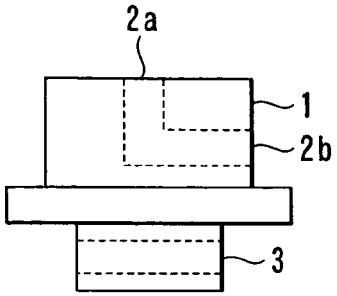
FIG. 1
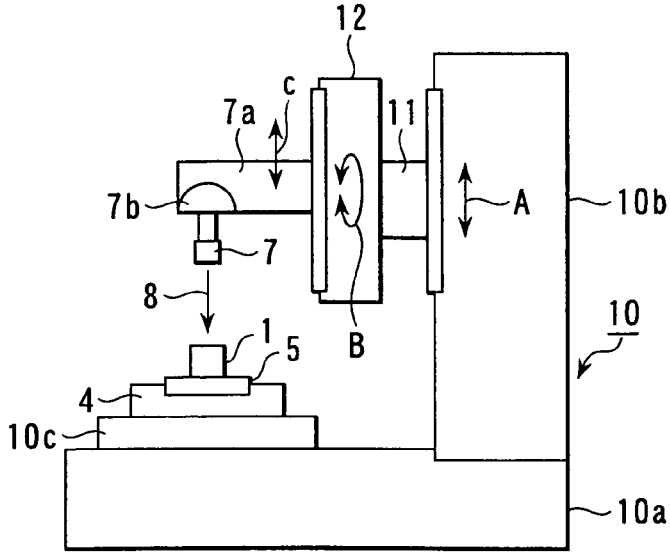
FIG. 2
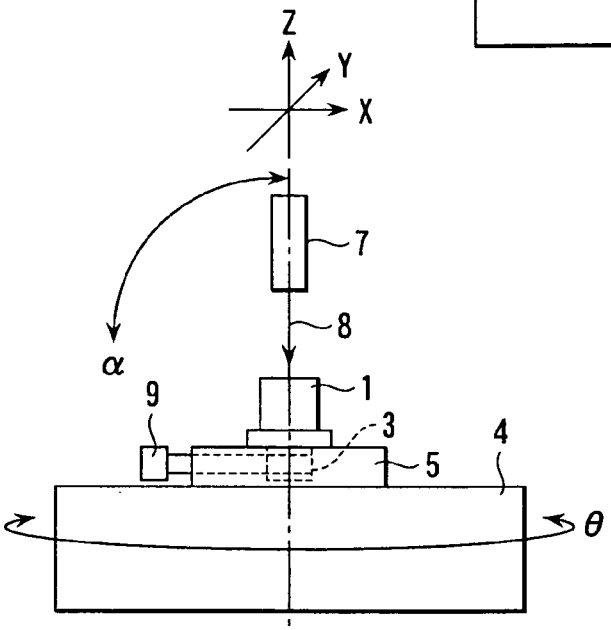
FIG. 3
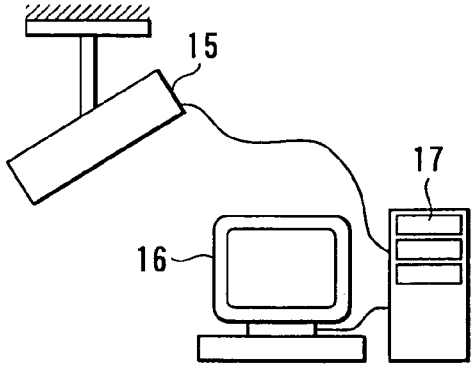
FIG. 4
FIG. 5
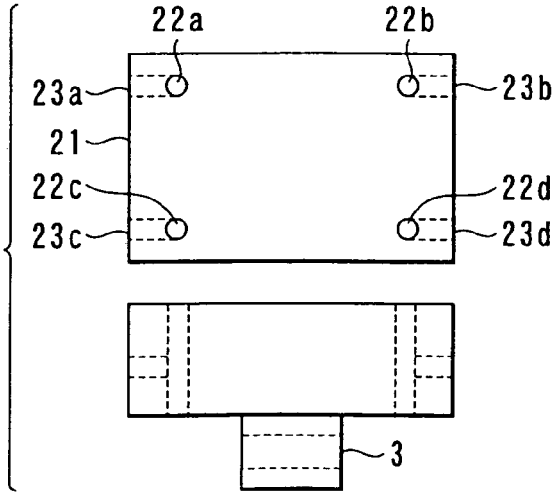

POSITIONING JIG, SPRAY POLISHING DEVICE USING POSITIONING JIG AND SPRAY POLISHING METHOD

CROSS-REFERENCE TO RELATED APPLICATIONS

This application is based upon and claims the benefit of priority from the prior Japanese Patent Application No. 2001-275528, filed Sep. 11, 2001, the entire contents of which are incorporated herein by reference.

BACKGROUND OF THE INVENTION

1. Field of the Invention

The present invention relates to a positioning jig used for a device which polishes a surface of an optical member and a substrate by spraying a polishing liquid to which the fluid and the polishing medicine are suspended, a spray polishing device with a positioning jig, and a spray polishing method.

2. Description of the Background Art

Conventionally, the technology disclosed in U.S. Pat. No. 5,971,835 is known as this kind of technology. U.S. Pat. No. 5,971,835 discloses a polishing method and a system to control a spraying direction with a solenoid while spraying a fluid in which magnetic polishing particles are suspended to the rotating work piece and to adjust the polishing position.

On the other hand, a technology which measures and confirms a distance between the material to be polished and the spraying nozzle of the fluid, and a technology in which a position of the material to be polished and the nozzle in a vertical surface to a spraying direction is measured and used as the spraying control data are also known, as other technologies.

However, in a conventional technology, an advanced technique is not considered such as confirming that whether the position and the direction of the nozzle, in a word, the spraying position and the spraying direction are suitable for the purpose in the spray polishing, and/or whether the turning center agrees with the target position when the nozzle is turned.

BRIEF SUMMARY OF THE INVENTION

The present invention relates to a positioning jig, a spray polishing device using the positioning jig and a spray polishing method which can confirm whether the position and the direction of the nozzle, in a word, the spraying position and the spraying direction are suitable for the purpose in the spray polishing and/or whether the turning center agrees with the target position when the nozzle is turned.

In the aspect of the present invention, the jig is used to decide a relative position between a spraying nozzle of the polishing liquid and a material to be polished. This jig can be attached by the same method and the same place as the material to be polished. The jig can be exchanged to the polishing material or another jig. A mechanism to know a position where the polishing liquid has been sprayed is provided to the jig. The mechanism is provided to visually confirm the position, and might comprise a function to measure the spraying position and the spraying pressure. Another jig has a shape having a part of the sphere. This jig becomes a standard which measures the distance and the position of the material to be polished and the nozzle at each nozzle position when the nozzle is turned. Similarly it becomes possible to decide tracks and the direction of the nozzle by measuring the distance and the position to the nozzle based on this measurement result even in a jig which has a shape having a part of non-sphere.

When the jig cannot be observed directly, for instance, when the jig is covered with a hood etc., an accurate nozzle position and the turning center, etc. are adjusted by imaging, displaying, and image-processing the appearance to spray the polishing liquid on the jig.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a figure which shows a schematic configuration of the first embodiment of the present invention;

FIG. 2 is a side view which shows a schematic configuration of the first embodiment;

FIG. 3 is a front view which shows a schematic configuration of the first embodiment;

FIG. 4 is a figure which shows a concrete application example of the first embodiment;

FIG. 5 is a figure which shows a schematic configuration of the second embodiment of the present invention;

DETAILED DESCRIPTION OF THE INVENTION

Figure 6:
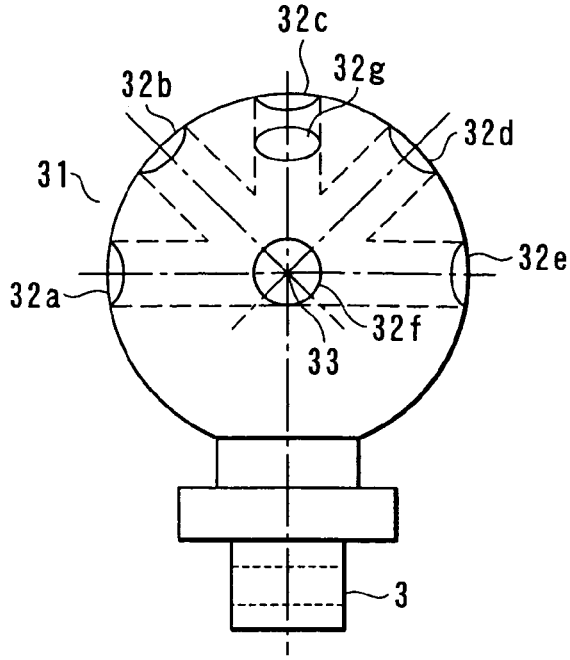
FIG. 6 is a figure which shows a schematic configuration of the third embodiment of the present invention.

Hereinafter, embodiments of the present invention will be explained referring to the drawings.

(First Embodiment)

The first embodiment of the present invention will be explained referring to FIG. 1 to FIG. 4.

As shown in FIG. 1, a hole 2*a* which is almost equal to the sectional diameter size of the jet 8 is provided on an upper center of the positioning jig 1 as a position detection mechanism to confirm a position to which the polishing liquid jet 8 is incident, for instance, marking as described later. The exhaust path 2*b* of the jet 8 is provided on the lateral face of the positioning jig 1. The exhaust path 2*b* prevents the jet 8 from flowing backward and jetting from the hole 2*a* again after the jet 8 is incident to the hole 2*a*. Thereby, the observation of the transit situation of the jet 8 can be facilitated. When the jig 1 is attached to the chuck 5 as described later, the rotation direction reference hole 3 to restrict the position of the direction of the rotation is provided to the jig 1.

FIG. 2 shows a schematic configuration of the polishing processing device to which the present invention is applied. In FIG. 2, the device main body 10 has a base 10*a* and a trunk 10*b* which is provided to stand upright to the base 10*a*.

A working table 10*c* is provided to the base 10*a* of the device main body 10. The working rotation table 4 is provided on the working table 10*c*. The working table 10*c* holds the working rotation table 4, and enables the movement of the working rotation table 4 along the X and Y directions. The working rotation table 4 is rotatable to the 0 direction around Z-axis as shown in FIG. 3.

A chuck 5 is provided on the working rotation table 4. This chuck 5 is used to attach the material to be polished or the holding device of the material to be polished (not shown in the figure) in the polishing process. The positioning jig 1 can be attached to the chuck 5 by the same method as when the material to be polished or the holding device of the material to be polished is held. In addition, the slide pin 9 is attached to the chuck 5 and the rotation direction/position can be restricted by inserting the slide pin 9 to the rotation direction reference hole 3 after the material to be polished or the holding device of the material to be polished or the positioning jig is attached to the chuck 5. Here, when the material to be polished has a shape to obtain a center position like the lens for instance, the working rotation table 4 and the chuck 5 comprise a centering mechanism. This centering mechanism agrees the rotation center of the working rotation table 4 with the center which is obtained by the material to be polished. For instance, it can be achieved by enabling the slight movement adjustment of the chuck 5 along the direction of X and Y on the working rotation table 4. If the center position is not obtained by the reason that the polishing surface of the material to be polished is the plane etc., a fixed chuck is used as the chuck 5. The chuck 5 is exchanged and is used according to the shape and the polishing condition etc. of the material to be polished as mentioned above.

In this case, by providing the Z-axis stage between the working rotation table 4 and the chuck 5, the material to be polished may be movable along the Z-axis direction. The working table 10*c* may have a configuration which comprises two or more materials to be polished.

On the other hand, a support arm 11 is provided to the trunk 10*b* of the device main body 10 to enable a vertical motion in the direction of arrow A shown in the figure. A rotation stage 12 is provided at the point of the support arm 11. The rotation stage 12 is rotatably supported at the point of the support arm 11 along the direction of arrow B shown in the figure. A nozzle table 7*a* is provided to the rotation stage 12. The nozzle table 7*a* is provided on the rotation stage 12 to be movable along the straight line along the direction of arrow C shown in the figure.

And, the nozzle 7 which jets the polishing liquid jet 8 through the rotation stage 7*b* is provided on the nozzle table 7*a*. This rotation stage 7*b* has a structure of the hemisphere which is set in a hemisphere receiving ditch on the nozzle table 7*a*, and so-called a universal joint. As a result, a direction of the nozzle to the material to be polished can be freely changed.

In this case, as a configuration which drives the nozzle 7, the nozzle 7 may be horizontally movable along the X direction and the Y direction. A piezoelectric element is put between the rotation stage 7*b* and the nozzle 7 and the nozzle 7 may be driven finely by using the transformation of the piezoelectric element. The nozzle 7 is not limited to one, but two or more nozzles 7 may be provided. In this case, a configuration of which the desired nozzle 7 is opposed to the material to be polished by arranging two or more nozzles 7 on the rotation stage 7*b* and moving straightly them along the arrow direction shown in the figure, and a rotary configuration such as turret lathes and revolvers to which the desired nozzle 7 is opposed to the material to be polished by arranging two or more nozzles 7 along a circumference direction on the rotation stage 7*b* and rotating and moving them are acceptable. Moreover, two or more sets of the support arm 11, the rotation stage 12, the nozzle table 7*a*, and the rotation stage 7*b* may be provided to the trunk 10*b* of the device main body 10. It becomes possible to perform spray from two or more nozzles 7 at the same time for the same part or the neighborhood thereof of the material to be polished in such a configuration. For instance, in the polishing process, it becomes possible to perform the simultaneous processing even when it is forced that two or more nozzles are arranged with the predetermined angle mutually, because the rotation stage 7*b* and the nozzle table 7*a* become obstructive for a previous processing part and the following processing part. In addition, the multi-axis robot arm as a means to hold, to move, and to rotate the nozzle 7 may be used. In this case, it is preferable to comprise the defense cover etc. so that the polishing medicine should not adhere directly to the arm.

FIG. 3 is a front view of FIG. 2 and is a figure which shows a schematic configuration only of the main part.

The nozzle 7 is arranged above the upper part of the chuck 5. The nozzle 7 is configured to be arbitrarily movable with the movement means which is not shown in the figure, along the Z direction parallel to the turning center of rotation table 4, the XY direction which is normal thereto, and the $\alpha$ direction (the tilt direction) by the controller which uses the microcomputer not show in the figure.

In the polishing device configured like the above-mentioned, after the positioning jig 1 is attached to the chuck 5 and the slide pin 9 is inserted thereto, the jet 8 is jetted from the nozzle 7 aiming at the positioning jig 1. And, it is visually confirmed that the jet 8 passes the hole 2*a* provided on the positioning jig 1. As a result, it can be confirmed that the jet 8 is jetted on a center line of the chuck 5.

The deflection direction and the deflection amount of the chuck 5 can be known by turning the rotation table 4 to the $\theta$ direction and visually confirming the transit situation of the jet 8, in a state of fixing the nozzle 7.

In addition, the direction of the inclination and the amount of the inclination of the nozzle 7 can be known by moving the nozzle 7 along the Z direction and visually confirming the transit situation of the jet 8, in a state of fixing the rotation table 4.

It is possible to adjust this relative position by the relative position adjustment part not shown in the figure by confirming the relative position of the nozzle 7 and the chuck 5 by this method. This means that a relative position of the nozzle and the chuck is easily obtained by the calculation when the material to be polished or the holding device of the material to be polished is attached to chuck 5.

The appearance from which the jet 8 is jetted to the hole 2*a* is visually confirmed in the first embodiment. As shown in FIG. 4, the imaging device 15, the display device 16, and the image processor 17 are added to the configuration of FIG. 3, and the appearance from which the jet 8 is jetted to the positioning jig 1 with imaging device 15 may be photographed (imaged). As a result, it becomes possible to perform the observation, when the positioning jig 1 cannot be observed directly visually. In addition, it becomes possible to measure the amount of the position shift accurately and to measure the shift amount automatically by performing the image processing.

(Second Embodiment)

The second embodiment of the present invention will be explained referring to FIG. 5.

The positioning jig 21 according to the embodiment is used by being attached to the polishing device explained referring to FIG. 3 in the first embodiment. Since the configuration of the polishing device is the same as that of the first embodiment, the explanation thereof will be omitted.

The holes 22*a* to 22*d* which are almost equal to the sectional diameter size of the jet 8 are provided at four places. On the upper surface of the positioning jig 21 as a position detection mechanism to confirm the position to which the polishing liquid jet 8 is incident from the nozzle 7, for instance, a marking. In addition, the exhaust paths 23*a* to 23*d* of the jet 8 are provided. The jet 8 is prevented from flowing backward and jetting from holes 22*a* to 22*d* again after the jet 8 is incident to the holes 22*a* to 22*d*, and the transit situation observation of the jet 8 is facilitated by the exhaust paths 23*a* to 23*d*.

The positioning jig 21 can be attached to the chuck 5 of the polishing device as the same holding method as when the material to be polished and the holding device of the material to be polished are held in the polishing process.

In the polishing device configured like the above-mentioned, after the positioning jig 21 is attached to the chuck 5 and the slide pin 9 is inserted, the jet 8 is jetted aiming at the hole 22*a* from the nozzle 7 by moving the position of the nozzle 7 along the XY direction. And, whether the jet 8 passes the hole 22*a* provided to the positioning jig 21 is visually confirmed. Subsequently, whether the jet 8 passes the holes 22*b* to 22*d* is visually confirmed by moving the nozzle 7 along two directions of XY directions only the same pitch as an interval between the holes 22*b* to 22*d* where are provided to the jig 21. Thus, it can be confirmed whether the jet 8 is jetted to the holes 22*a* to 22*d* by moving the nozzle 7 in a predetermined amount along the XY direction.

In addition, the direction of the inclination and the amount of the inclination of nozzle 7 is decided and the inclination of the nozzle 7 and the position thereof are controlled in the XY direction by observing the street state of the jet 8 by fixing and moving the movement of the XY direction of nozzle 7 in the Z direction at the position where the jet 8 is jetted to the hole 22*a* or holes 22*b* to 22*d* of the positioning jig 21.

It is possible to confirm the relative position of the nozzle 7 and the chuck 5 and correct the relative position by the relative positioning part not shown in the figure in the above-mentioned method. This means that it is preferable when performing plane polishing of the material to be polished such as the prism and the base and the relative position with the material polished to be attached to the nozzle 7 and the chuck 5 or the holding device of the material to be polished can be easily decided by the calculation by using the positioning jig 21.

(Third Embodiment)

The third embodiment of the present invention will be explained referring to FIG. 6.

The positioning jig 31 according to the embodiment is used by attaching to the polishing device which has been explained referring to FIG. 3 in the first embodiment. Since the configuration of the polishing device is the same as that of the first embodiment, the explanation thereof will be omitted.

The positioning jig 31 can be also attached to the chuck 5 in the same holding method as the time when the material to be polished or the holding device of the material to be polished is held in the polishing process. The externals of the positioning jig 31 are spherical, on the surface of the sphere, as the position detection mechanism for confirming the position to which the polishing liquid jet 8 is incident, for instance, as a marking, two or more holes 32*a*, 32*b*, 32*c*, . . . , 32*g* which are almost equal to the sectional diameter size of the jet 8 are provided toward the direction of the center 33 of the sphere of the positioning jig 31. The marking is provided to the position at which the line connecting a center point of the sphere of the positioning jig 31 with the center of nozzle 7 and the surface of the positioning jig 31 are intersected. These plurality of holes are connected near the center 33 of the sphere of the positioning jig 31, and also has the function to exhaust the jet 8. As a result, the jet 8 is prevented from jetting from the backflow to the holes 32*a*, 32*b*, 32*c*, . . . , 32*g* again after the jet 8 is incident thereto, the observation of the situation for the jet 8 to pass holes 32*a*, 32*b*, 32*c*, . . . , 32*g* is facilitated.

The position of the center 33 of the sphere when the positioning jig 31 is attached to the chuck 5 becomes the size configuration to agree with the center of curvature on the surface of the material to be polished, when the holding device which holds the material from which spherical shape is polished or the material to which spherical shape is polished is attached to chuck 5

In the polishing device configured as mentioned above, after the positioning jig 31 is attached to the chuck 5 and the slide pin 9 is inserted, the jet 8 is jetted from the nozzle 7 aiming at the positioning jig 31. Then, the position of the nozzle 7 of the X and Y directions is moved so that the jet 8 may pass the hole 32*c* provided to the positioning jig 31.

Subsequently, the nozzle 7 is inclined in the $\alpha$ direction only in a predetermined amount, and passing the jet 8 through the hole 32*b* is visually confirmed.

Next, the nozzle 7 is moved along the center line of the hole 32*b*, and it is visually confirmed that the jet 8 passes the hole 32*b*. Similarly, the nozzle 7 is inclined in the a direction only in a predetermined amount, the nozzle 7 is moved along the center line of the hole 32*a* and hole 32*e*, and passing the jet 8 is confirmed.

Subsequently, the rotation table is rotated in a predetermined amount, the nozzle 7 is inclined in a predetermined amount in the a direction, and it is confirmed that the jet 8 passes the hole 32*g* and the hole 32*f*. In addition, the nozzle 7 is moved along the center line of the hole 32*g* and the hole 32*f*. It is confirmed that the jet 8 passes the hole 32*g* and the hole 32*f*.

By observing the state for the jet 8 to pass through entire or a part of these two or more holes 32*a*, 32*b*, and 32*c*, . . . , 32*g*, the shift amount between the turning center of the jet 8 and the center of the sphere of the positioning jig 31 can be confirmed.

When polishing the material to be polished with the spherical shape such as lenses by spraying the polishing liquid, it is desirable that the direction where the polishing liquid is jetted is normal to the lens surface to accurately control the amount of the polishing, in a word, the turning (tilt) center of the α direction of nozzle 7 agrees with the center point of the sphere of the lens surface to be processed. Therefore, as the above-mentioned embodiment, by using the positioning jig with the spherical shape having the same shape as or similar shape to the lens surface to be processed, the relative position of the sphere center of the material to be polished and the nozzle 7 can be confirmed and be adjusted easily.

Even if the surface of the material to be polished is not only sphere but also aspheric near the sphere etc., the direction of the nozzle 7 can be agreed with the center of an approximate sphere in the aspheric by this method.

The number of holes is seven in the embodiment, but it is not limited to this, and even if the number thereof is increased or decreased, the similar effect can be achieved.

(Fourth Embodiment)

Figure 7:
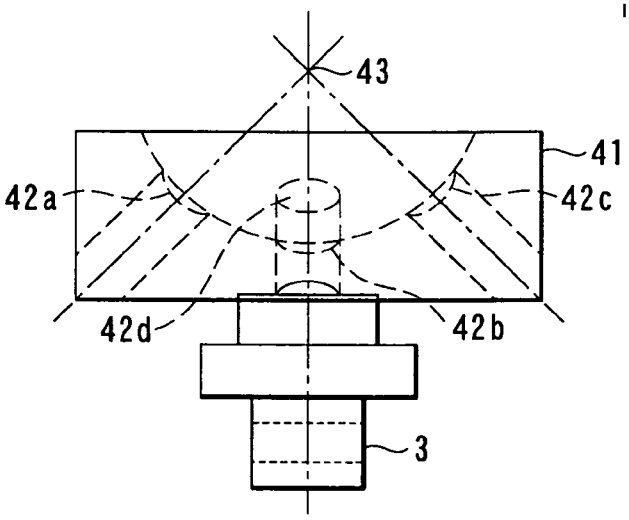
FIG. 7 is a figure which shows a schematic configuration of the fourth embodiment of the present invention.

The fourth embodiment of the present invention is shown in FIG. 7.

In the embodiment, the positioning jig is used when the concave shape is polished, while the positioning jig according to the third embodiment is used for the positioning when polishing the sphere or the substantially sphere such as convex lenses.

The positioning jig 41 is used for the same polishing device explained referring to FIG. 3 in the first embodiment.

The positioning jig 41 can be attached to the chuck 5 of the polishing device by the same holding method as when the material to be polished or the holding device of the material to be polished is held in the polishing process. The externals of the positioning jig 41 have a concave spherical. Two or more holes 42*a*, 42*b*, 42*c*, and 42*d* which are almost equal to the sectional diameter size of the jet 8 are provided toward the direction of the center 43 of the sphere of concave of the positioning jig 41 as the marking to confirm the position to which the polishing liquid jet 8 is incident on a spherical surface. The marking is provided to the position at which the line where a center point of the sphere of the positioning jig 41 and the center of the nozzle 7 are connected and the surface of the positioning jig 41 are intersected. These plural holes 42*a*, 42*b*, 42*c*, and 42*d* penetrate to the opposite side to the concave of the positioning jig 41, and has a function to exhaust the jet 8 concurrently. As a result, the jet 8 is prevented from jetting from the backflow to the holes 42*a*, 42*b*, 42*c*, and 42*d* again after the jet 8 is incident thereto, and the observation of the situation for the jet 8 to pass the holes 42*a*, 42*b*, 42*c*, and 42*d* is facilitated.

The position of the center 43 of the sphere when the positioning jig 41 is attached to the chuck 5 agrees with the center of curvature of the surface of the material to be polished, when the holding device which holds the material to be polished with the concave or the material to be polished with concave shape is attached to chuck 5

After the positioning jig 41 is attached to the chuck 5 and the slide pin 9 is inserted, the jet 8 is jetted from the nozzle 7 aiming at the positioning jig 41, and the position of the nozzle 7 of the X and Y directions is moved so that the jet 8 may pass the hole 42*b* which is provided to the positioning jig 41. Subsequently, the nozzle 7 is inclined in the α direction only in a predetermined amount, and the nozzle is moved along the Z direction to pass the jet 8 through the hole 42*a*. The appearance of which the jet 8 passes the hole 42*a* is visually confirmed. Passing the jet 8 through the hole 42*c* is similarly confirmed.

In addition, the rotation table 4 is rotated in a predetermined amount, and the nozzle 7 is inclined in the α direction in a predetermined amount. As a result, it is confirmed that the jet 8 passes the hole 42*d*.

By observing the state for the jet 8 to pass through the entire or a part of these two or more holes 42*a*, 42*b*, 42*c*, and 42*d*, the shift amount from the center of the sphere of the positioning jig 41 of the jet 8, that is, the center of curvature on the surface of the material to be polished can be confirmed.

A similar effect to the third embodiment can be achieved for the concave sphere or the substantially concave sphere according to the embodiment. The number of holes is four in the embodiment, but it is not limited to this, and even if the number thereof is increased or decreased, the similar effect can be achieved.

(Fifth Embodiment)

Figure 8:
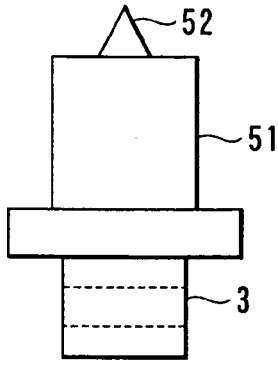
FIG. 8 is a figure which shows a schematic configuration of the fifth embodiment of the present invention.

The fifth embodiment of the present invention is shown in FIG. 8.

The positioning jig 51 has a projection part 52 at the point thereof. The positioning jig 51 can be attached to the chuck 5 of the polishing device by the same holding method as when the material to be polished or the holding device of the material to be polished is held in the polishing process. The size is assumed to be set such that the projection part 52 can be arranged at the same position as the center 33 of the sphere of the positioning jig 31 of the third embodiment.

The positioning jig 51 is used for the same polishing device explained referring to FIG. 3 in the first embodiment.

In the polishing device configured as mentioned above, it is confirmed whether the jet 8 is hit to a point of projection part 52 similar to passing the jet 8 through the holes 32*a*, 32*b*, 32*c*, . . . , in the third embodiment, when the position of nozzle 7 is moved in each of X, Y, Z, and α directions.

Therefore, a similar effect to that of the third embodiment can be achieved.

In addition, since the structure of the positioning jig 51 of the embodiment is easier than the positioning jig 31 in the third embodiment, the shift amount from the center of curvature of the surface of the material to be polished can be confirmed cheaply.

(Sixth Embodiment)

Figure 9:
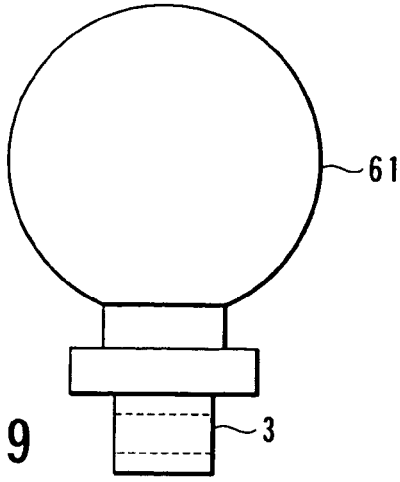
FIG. 9 is a figure which shows a schematic configuration of the sixth embodiment of the present invention.

The sixth embodiment of the present invention will be explained referring to FIG. 9 and FIG. 10.

The positioning jig 61 is used for the same polishing device explained referring to FIG. 3 in the first embodiment.

The positioning jig 61 is spherical. The positioning jig 61 can be attached to the chuck 5 of the polishing device by the same holding method as when the material to be polished or the holding device of the material to be polished is held in the polishing process.

The center of the sphere of the positioning jig 61 is configured with the size which becomes the same position as the center of curvature of the material in which the holding device to which the material to be polished is attached or the material to be polished to the chuck 5 of the polishing device.

Figure 10:
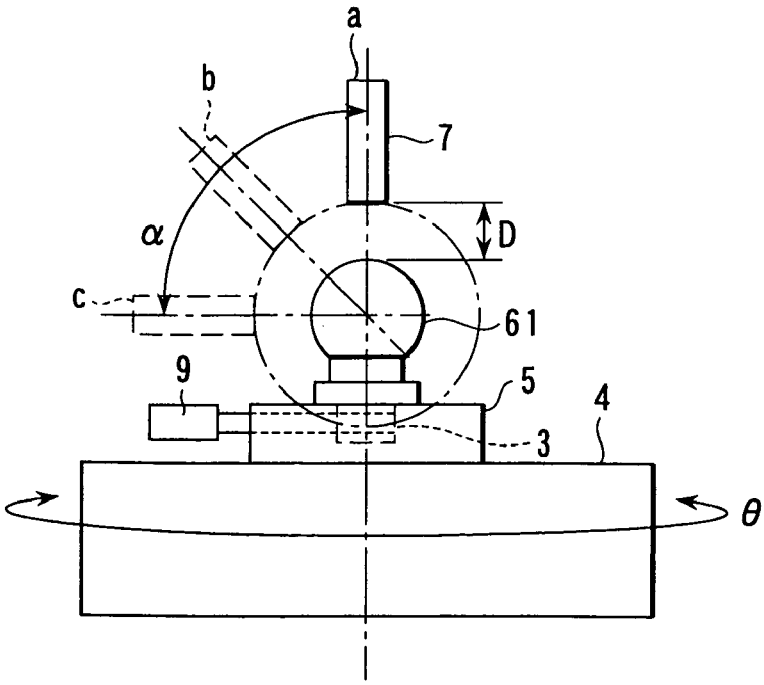
FIG. 10 is a figure which shows a schematic configuration of the sixth embodiment.

The nozzle 7 is moved along the X, Y, and Z directions and is located at a in FIG. 10, so that the inclination of the α direction thereof becomes 0 for Z-axis. At this time, the distance between the positioning jig 61 and the point of the nozzle 7 becomes D. Next, the Nozzle 7 is rotated to the α direction, and is moved to the positions of b and c in is FIG. 10, and the distance is measured by inserting the block gauge between the positioning jig 61 and the nozzle 7. In addition, the rotation table 4 rotated in a predetermined amount, and the distance between the positioning jig 61 and the nozzle 7 is similarly measured at the positions of a, b, and c. It is confirmed that the distance between the nozzle 7 and the positioning jig 61 is D at any position. The distance D may be 0.

According to the embodiment, the relative position of the nozzle 7 and the sphere center of the material to be polished can be easily confirmed and adjusted as well as the second embodiment.

In the embodiment, the relative position of the nozzle 7 and the sphere center of the material to be polished can be easily confirmed and adjusted, when the surface shape of the positioning jig 61 is the surface shape of the material to be polished, the surface shape after the material to be polished is processed, or the part of the sphere.

In addition, when the center of the spherical shape of the positioning jig is the same position as the center of the material to be polished, the relative position of the nozzle 7 and the sphere center of the material to be polished can be confirmed and adjusted more accurately.

(Seventh Embodiment)

The seventh embodiment of the present invention will be explained referring to FIG. 11 and FIG. 12.

Figure 11:
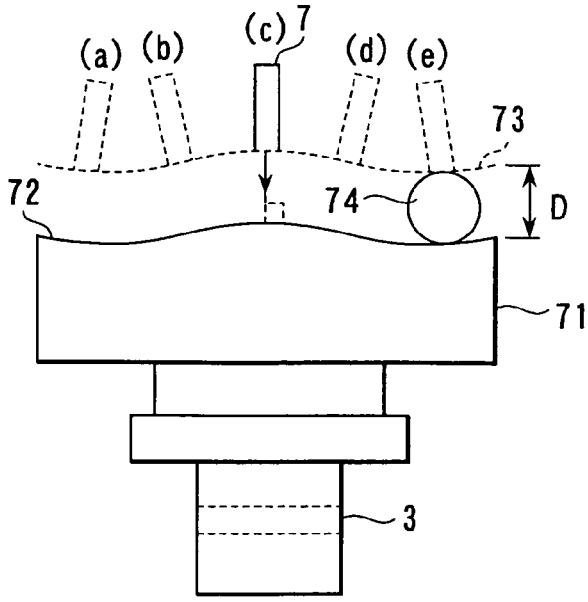
FIG. 11 is a figure which shows a schematic configuration of the seventh embodiment of the present invention.

The positioning jig 71 shown in FIG. 11 is used for the same polishing device explained referring to FIG. 3 in the first embodiment.

The upper surface 72 of the positioning jig 71 forms a free curved surface. The positioning jig 71 can be attached to the chuck 5 of the polishing device by the same holding method as when the material to be polished or the holding device of the material to be polished is held in the polishing process.

The upper surface 72 of the positioning jig 71 is configured with the size which becomes the same position as the surface of the material to polished when the holding device which attaches the material to be polished is held to the chuck 5 of the polishing device or the material to be polished.

Figure 12:
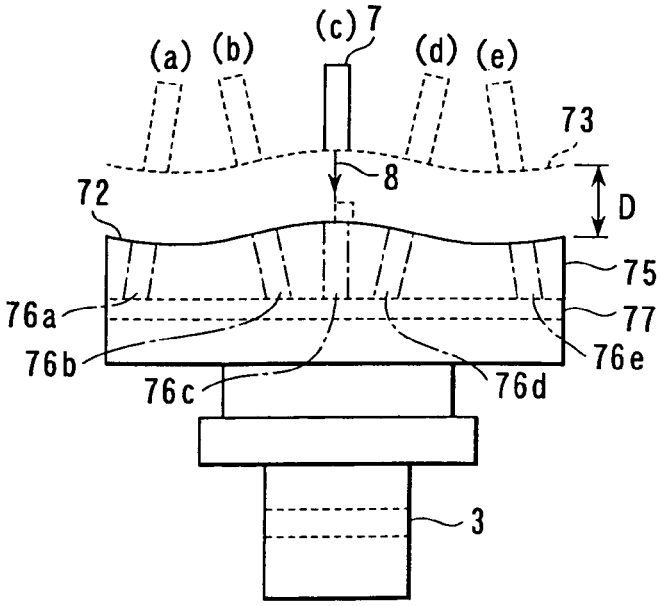
FIG. 12 is a figure which shows a schematic configuration of the seventh embodiment.

The positioning jig 75 shown in FIG. 12 has a shape having holes 76*a* to 76*e* which are equal to the sectional diameter size of the jet 8 and are normal to the upper surface 72 as the position detection mechanism for confirming the position to which the polishing liquid jet 8 is incident, for instance, as a marking, and the exhaust path of the jet 8. The jet 8 is prevented from flowing backward and jetting from holes 76*a* to 76*e* to the holes 76*a* to 76*e* again after the jet 8 is incident thereto, and the transit situation observation of the jet 8 is facilitated by the exhaust path 77.

The controller of the polishing device is programmed to move the nozzle 7 along the track 73 of the dotted line shown in FIG. 12. At this time, it is programmed that the distance between the track 73 and the upper surface72 of the positioning jig 71 is D and is constant, and the jet 8 is normal to the upper surface 72 of the positioning jig 71.

The rotation table 4 is fixed and the nozzle 7 is moved to the positions of (a), (b), (c), (d), and (e) shown in FIG. 12 by the program of the polishing device. And, the jet 8 is jetted aiming at holes 76*a* to 76*e* provided to the positioning jig 75 from the nozzle 7 at each of positions (a), (b), (c), (d), and (e). Then, it is visually confirmed that the jet 8 passes the hole 76*a* to the hole 76*e*. In addition, by moving the nozzle 7 to the vertical direction to the upper surface 72 at the positions of (a), (b), (c), (d), and (e) and observing the transit of the jet 8, the direction of the inclination of the nozzle 7 and the amount thereof can be known.

The steel ball 74 is inserted in a state that the positioning jig 75 is changed to the positioning jig 71 shown in FIG. 11 and the nozzle 7 is positioned at the positions of (a), (b), (c), (d), and (e), and the distance D is measured by moving the nozzle 7 to the vertical direction to the upper surface 72.

The relative position and the relative angle between the nozzle 7 and the material to be polished can be confirmed and adjusted easily for the free curved surface by the embodiment as well as embodiment 6.

Though the free curved surface is used in the embodiment; the similar effect can be achieved with the curved surface shown by a predetermined function like non-sphere or the plane, for instance, even in the case that there is not the free curved surface, (Eighth Embodiment)

Figure 13:
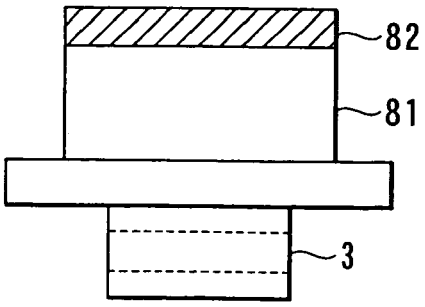
FIG. 13 is a figure which shows a schematic configuration of the eighth embodiment of the present invention.
Figure 14:
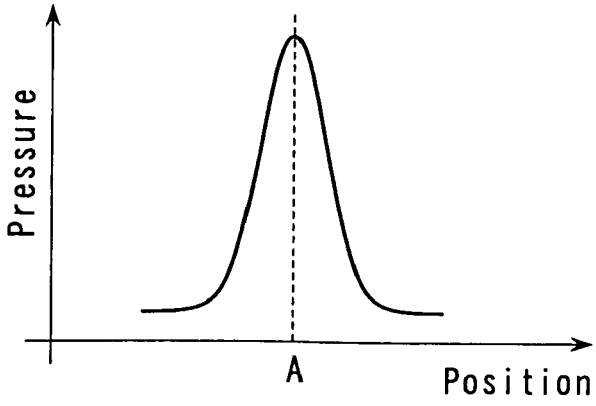
FIG. 14 is a figure which shows a schematic configuration of the eighth embodiment.

The seventh embodiment of the present invention will be referring to FIG. 13 and FIG. 14.

The positioning jig 81 is used for the same polishing device explained referring to FIG. 3 in the first embodiment.

There is a pressure sensor 82 on the positioning jig 81. The upper surface of the pressure sensor 82 is a plane, pressure sensors are arranged on the plane, and the pressures can be detected at each of two-dimensional positions.

This positioning jig 81 can be attached to the chuck 5 of the polishing device by the same method as when the material to be polished or the holding device of the material to be polished is held in the polishing processing.

The pressure sensor 82 is configured with the size which becomes the same position as the surface of the material to be polished when the holding device which attaches the material polished is held to the chuck 5 of the polishing device or the material to be polished.

The positioning jig 81 is attached to the polishing device and the jet 8 is jetted to the positioning jig 81 from the nozzle 7. The pressure sensor 82 detects the pressure by the jet 8, and this pressure shows a distribution as shown in FIG. 14. A position A where the pressure becomes the maximum in FIG. 14 is a position where the jet 8 hits the pressure sensor 82.

By confirming the pressure becomes the maximum at a predetermined position of the pressure sensor 82 provided on the upper surface of the positioning jig 81 like this; it can be confirmed the jet 8 is jetted on a center line of the chuck 5.

In addition, by confirming the pressure detection distribution while moving the nozzle 7 along the Z direction; the direction and the amount of the inclination in the Z direction of the nozzle 7 can be known.

By turning the rotation table 4 to the θ direction in a state of fixing the nozzle 7 and confirming the pressure detection distribution of the pressure sensor 82; the deflection direction of the chuck 5 and the deflection amount can be known.

The relative position of the nozzle 4 and the chuck 5 can be confirmed by using the pressure sensor with the above-mentioned method. It is possible to adjust the relative positioning by the relative position part not shown in the figure.

As described above, according to the present invention, the polishing device and the polishing method to polish the arbitrary part or entire of the material to be polished with high accuracy and obtain the target surface shape by spraying the polishing liquid to the material to be polished.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A polishing device which polishes a material to be polished by spraying a polishing liquid onto the material, said polishing device comprising:

a positioning jig including position detection means for checking an incidence position of a polishing liquid jet;

means for attaching the positioning jig to the polishing device such that the positioning jig is exchangeable for the material to be polished;

means for spraying the polishing liquid jet onto the position detection means of the positioning jig, to thereby determine a relative spray position and a relative spray angle of a polishing liquid spraying nozzle of the polishing device with respect to a position of the material to be polished.

2. The polishing device according to claim 1, wherein a holding device for holding the material during polishing is attachable to the polishing device by a same mechanism as the positioning jig.

3. The polishing device according to claim 1, wherein the position detection means comprises a plurality of position detection members.

4. The polishing device according to claim 1, wherein the position detection means comprises a position detection member provided at a position such that a line connecting a center of a nozzle hole of the polishing liquid spray nozzle and a position where an arbitrary point of the material to be polished is to be located during polishing intersects a surface of the positioning jig.

5. The polishing device according to claim 4, wherein the arbitrary point of the material to be polished is a center of a spherical lens surface of the material to be polished.

6. The polishing device according to claim 1, wherein a surface of the positioning jig to which the polishing liquid jet is incident is a plane.

7. The polishing device according to claim 1, wherein the position detection means comprises a hole.

8. The polishing device according to claim 7, further comprising an exhaust path for polishing liquid incident to the hole.

9. The polishing device according to claim 1, wherein the position detection means comprises a projection.

10. The polishing device according to claim 1, wherein a surface shape of the positioning jig corresponds to a range of movement of a nozzle point of the polishing liquid spray nozzle.

11. The polishing device according to claim 1, wherein a distance between a nozzle point of the polishing liquid spray nozzle and the incidence position on the positioning jig of the polishing liquid jet is substantially constant throughout a range of movement of the nozzle point of the polishing liquid spray nozzle.

12. The polishing device according to claim 1, wherein a surface shape of the positioning jig is substantially the same as a surface shape of the material to be polished.

13. The polishing device according to claim 12, wherein the surface shape of the positioning jig is spherical.

14. The polishing device according to claim 13, wherein a center of the spherical surface shape of the positioning jig corresponds to a position at which a center of the material to be polished is to be located.

15. The polishing device according to claim 12, wherein the surface shape of the positioning jig is not spherical.

16. The polishing device according to claim 1, wherein the position detection means comprises a pressure sensor.

17. The polishing device according to claim 16, wherein the pressure sensor is adapted to detect a pressure distribution.

18. A method of polishing a material by spraying a polishing liquid thereto from a polishing liquid spray nozzle of a spray polishing device, said method comprising:

spraying the polishing liquid onto a positioning jig at position detection means thereof for checking an incidence position of the polishing liquid on the positioning jig, to thereby determine a relative spray position and a relative spray angle of the polishing liquid spraying nozzle of the spray polishing device with respect to a position of the material to be polished;

exchanging the material to be polished for the positioning jig; and polishing the material to be polished.

19. The spray polishing method according to claim 18, further comprising photographing the incidence position where the polishing liquid is incident to the positioning jig.

20. The spray polishing method according to claim 19, further comprising displaying a photographed image.

21. The spray polishing method according to claim 19, further comprising processing a photographed image.

22. The spray polishing method according to claim 18, wherein the position detection means of the positioning jig comprises a pressure sensor.

23. A positioning jig for a spray polishing device which sprays a polishing liquid to a material to be polished, wherein the positioning jig comprises:

a position detection member for use in determining a relative position of a polishing liquid spraying nozzle of the spray polishing device with respect to the material to be polished;

wherein the position detection member is provided at a position such that a line connecting: (i) a center of a nozzle hole of the polishing liquid spray nozzle and (ii) a position where an arbitrary point of the material to be polished during polishing, intersects a surface of the positioning jig.

24. The positioning jig according to claim 23, wherein the arbitrary point of the material to be polished is a center of a spherical lens surface of the material to be polished.

25. A positioning jig for a spray polishing device which sprays a polishing liquid to a material to be polished, wherein the positioning jig comprises:

a position detection member for use in determining a relative position of a polishing liquid spraying nozzle of the spray polishing device with respect to the material to be polished;

wherein the position detection member comprises a projection.

26. A positioning jig for a spray polishing device which sprays a polishing liquid to a material to be polished, wherein the positioning jig comprises:

a spherical surface that is substantially the same as a surface shape of the material to be polished; and wherein a center of the spherical surface of the positioning jig corresponds to a position at which a center of the material to be polished is to be located for polishing.

27. A positioning jig for a spray polishing device which sprays a polishing liquid to a material to be polished, wherein the positioning jig comprises:

a position detection member for use in determining a relative position of a polishing liquid spraying nozzle of the spray polishing device with respect to the material to be polished;

wherein the position detection member comprises a pressure sensor.

28. The positioning jig according to claim 27, wherein the pressure sensor detects a pressure distribution.

* * * * *